US006206539B1

(12) United States Patent
Ko

(10) Patent No.: US 6,206,539 B1
(45) Date of Patent: Mar. 27, 2001

(54) FLASHLIGHT WITH FOCAL LENGTH ADJUSTMENT MEANS

(76) Inventor: Kent Ko, No. 342, Ta Tung Road, Koei Shan Hsiang, Taoyuan Hsien (TW)

( * ) Notice: Subject to any disclaimer, the term of this patent is extended or adjusted under 35 U.S.C. 154(b) by 0 days.

(21) Appl. No.: 09/412,428

(22) Filed: Oct. 5, 1999

(51) Int. Cl.[7] ..... F21L 14/00; F21V 14/02
(52) U.S. Cl. ..... 362/157; 362/204
(58) Field of Search ..... 362/204, 187, 362/188, 196

(56) References Cited

U.S. PATENT DOCUMENTS

| | | | | |
|---|---|---|---|---|
| 2,107,599 | * | 2/1938 | Chan | 362/188 |
| 2,124,153 | * | 7/1938 | Scholtes | 362/188 |
| 5,171,086 | * | 12/1992 | Baloochi | 362/188 |
| 5,282,116 | * | 1/1994 | Shiau | 362/205 |

* cited by examiner

*Primary Examiner*—Laura K. Tso
(74) *Attorney, Agent, or Firm*—Rosenberg, Klein & Lee

(57) ABSTRACT

A flash light, which includes a barrel holding a battery set, and a lamp case and rim assembly, a holder shell mounted in the barrel at a front side, a lamp complete mounted in the holder shell assembly and forced backward by a spring, a switch mounted in the barrel and operated to turn on/off the lamp bulb of the lamp complete, wherein the lamp complete has a beveled stop edge at the expanded rear end thereof, and a stop flange backwardly extended from the expanded rear end; a focal length adjustment device is installed in the barrel around the button of the switch for adjusting the focal length of the flash light, the focal length adjustment device including a lower actuating member mounted around the button of the switch and having an actuating rod stopped at the beveled stop edge at the lamp complete, an upper actuating member coupled to the lower actuating member at a top side and having a lever for turning by hand to rotate the lower actuating member for enabling the lamp complete to be moved forwards/backwards to adjust the focal length of the flash light, and a button mounted within the upper actuating member and supported on the button of the switch for pressing by hand to switch on/off the switch.

2 Claims, 6 Drawing Sheets

FLASHLIGHT WITH FOCAL LENGTH ADJUSTMENT MEANS

BACKGROUND OF THE INVENTION

The present invention relates to a flashlight, and more particularly to such a flashlight, which has adjustment means for adjusting the focal length of the lamp bulb.

The focal length of a regular flashlight is adjusted by rotating the rim on the lamp case to move the lens relative to the lamp bulb. This focal length adjustment procedure must be performed with both hands, i.e., with one hand holding the barrel of the flash light, and the other hand rotating the rim on the lamp case.

SUMMARY OF THE INVENTION

It is one object of the present invention to provide a flashlight, which has a focal length adjustment device that can be conveniently operated with one hand to adjust the focal length of the lamp bulb. It is another object of the present invention to provide a flashlight, which has a focal length adjustment device that can be operated with one hand to adjust the focal length of the lamp bulb steplessly. It is still another object of the present invention to provide a flashlight, which has water-sealing means to provide the internal circuit.

DETAILED DESCRIPTION OF THE PREFERRED EMBODIMENT

Figure 1:
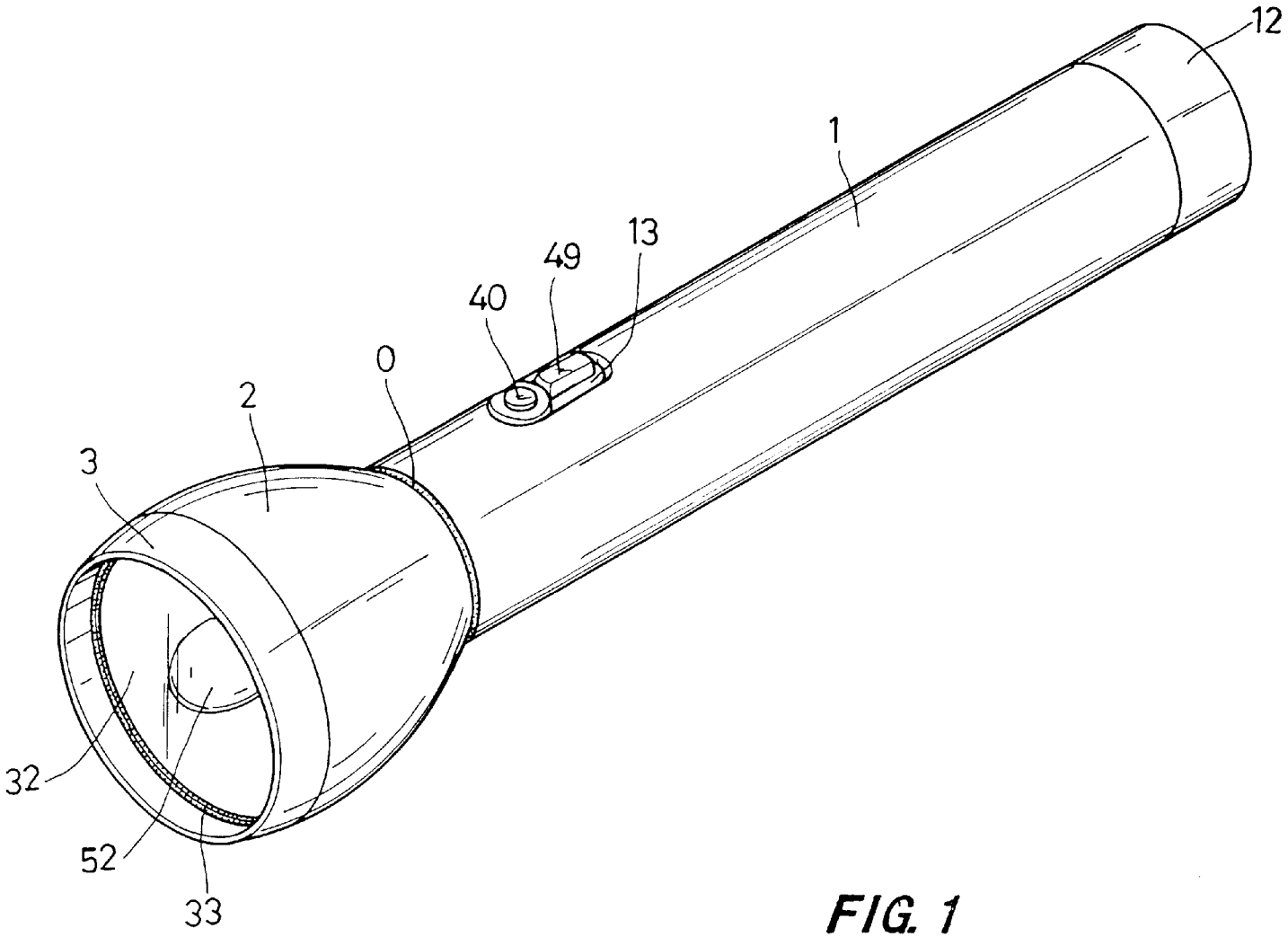
FIG. 1 is an elevational view of a flashlight according to the present invention.
Figure 2:
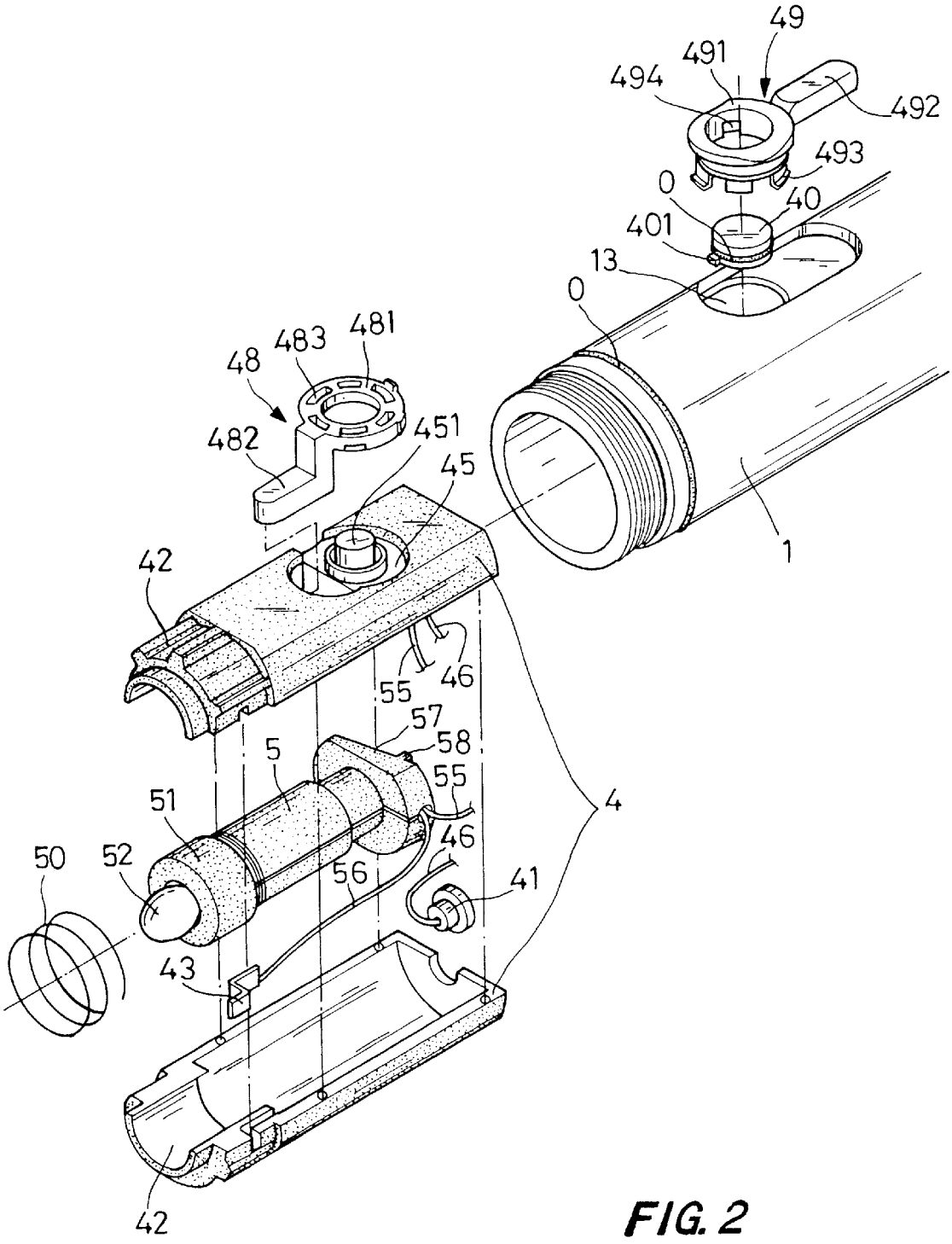
FIG. 2 is an exploded view of a part of the flashlight according to the present invention.
Figure 3:
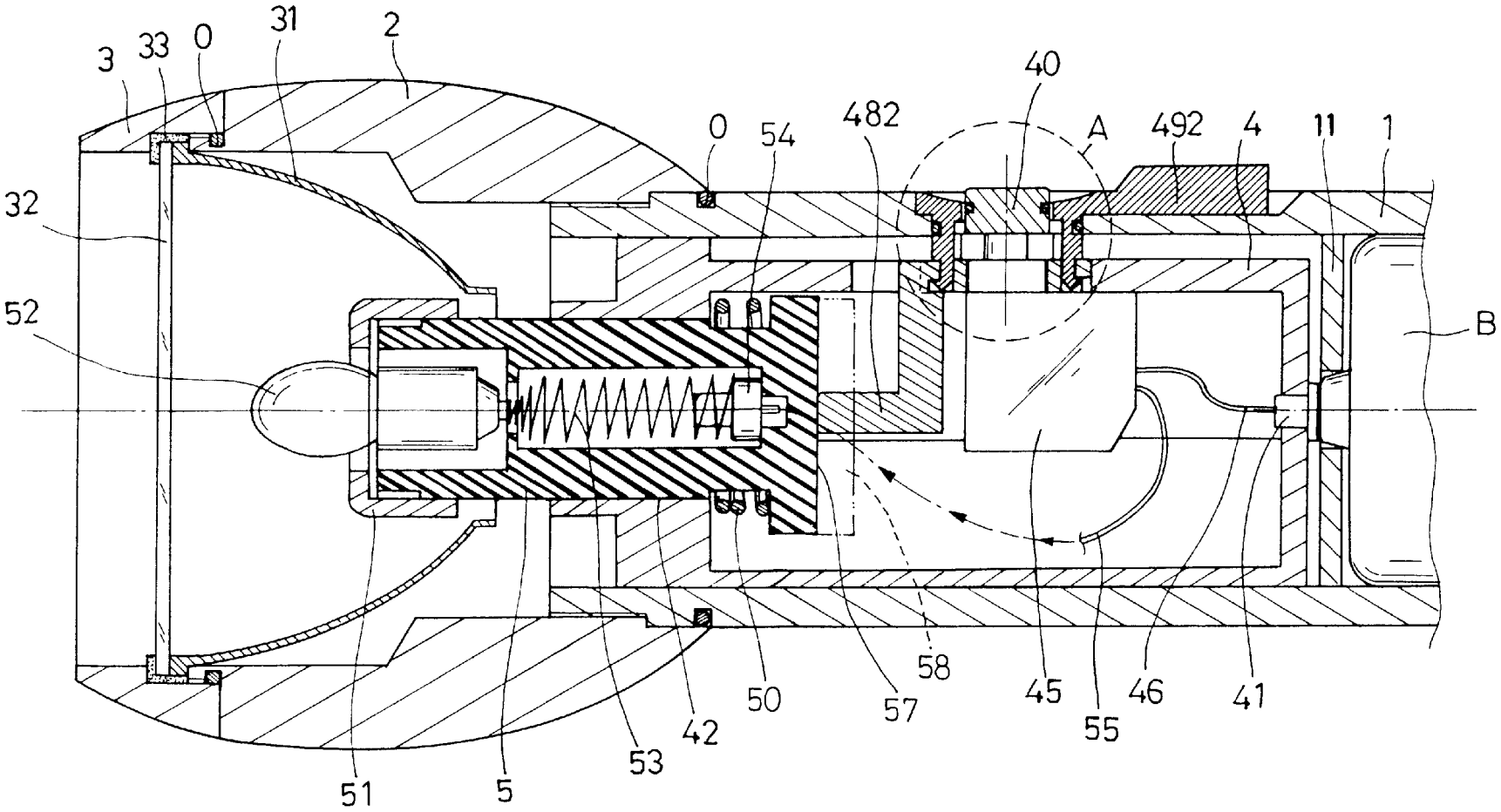
FIG. 3 is a sectional side view in an enlarged scale of the front part of the flashlight according to the present invention.
Figure 4:
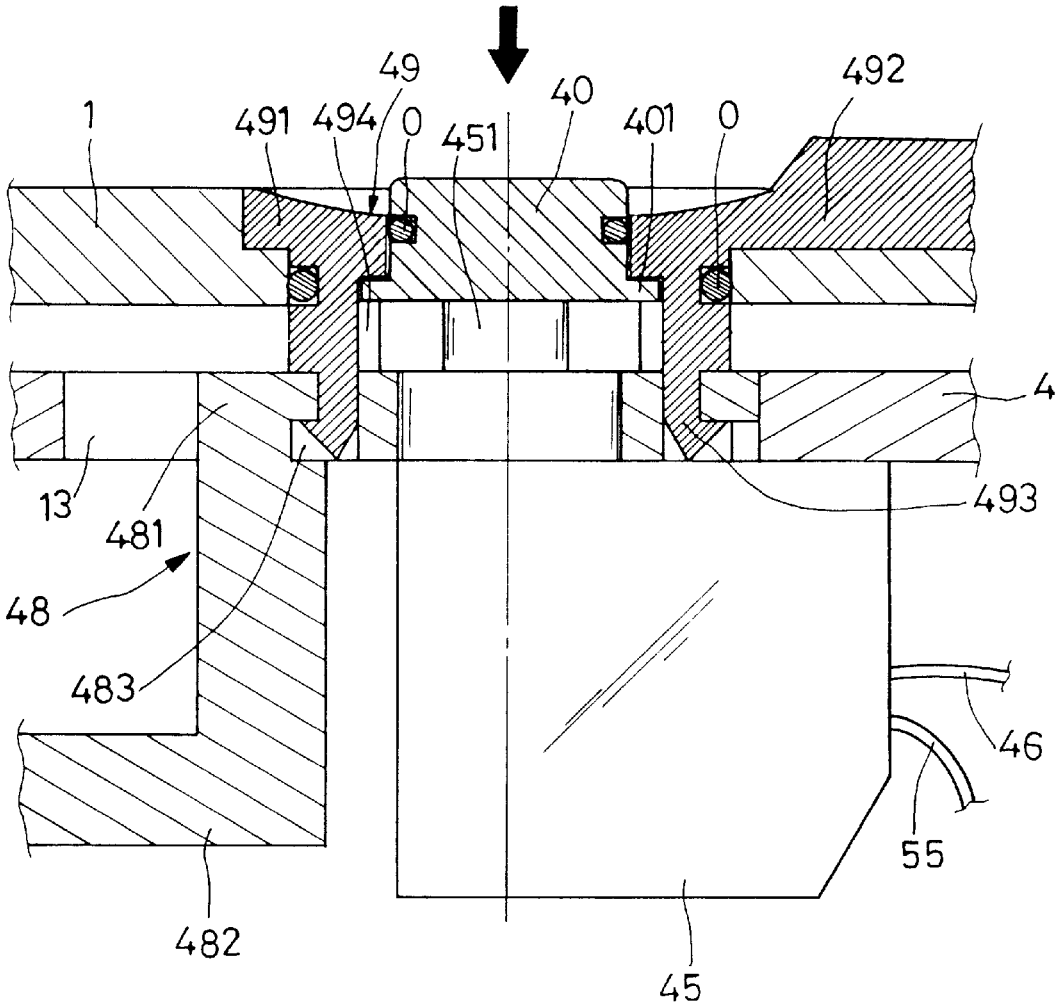
FIG. 4 is an enlarged view of part A of FIG. 3.

Referring to FIGS. from 1 through 4, a flashlight is shown comprised of a metal barrel 1, a lamp case 2, a rim 3, a holder shell assembly 4, a switch 45, and a lamp complete 5.

The metal barrel 1 comprises an insulative partition board 11 on the middle, a metal rear cap 12, a battery set B mounted in the space defined between the partition board 11 and the rear cap 12, and a button hole 13 at the periphery near the front end thereof The negative terminal of the battery set B is supported on a metal spring (not shown) inside the metal rear cap 12, and electrically connected to the metal barrel 1 through the metal rear cap 12. The positive terminal of the battery set B is inserted through a through hole at the center of the partition board 11. The lamp case 2 is fastened to the front end of the barrel 1. The rim 3 is covered on the lamp case 2 at the front side, having a sealing rubber 33 mounted on the inside to hold a reflector 31 within the lamp case 2 and a lens 32 in front of the lamp case 2. The holder shell assembly 4 is mounted in the front end of the metal barrel 1, comprising a negative pole metal contact plate 43 mounted on the outside at one side and disposed in contact with the metal barrel 1, a positive pole metal contact plate 41 provided at the rear end thereof and disposed in contact with the positive terminal of the battery set B, and a front locating ring 42. The switch 45 is mounted on the holder shell assembly 4, having a positive terminal contact connected to the positive pole metal contact plate 41 of the holder shell assembly 4 by a conductor 46, a negative terminal contact connected to the negative terminal of the lamp complete 5, and a button 451 extended out of the button hole 13 at the metal barrel 1 for operation by hand to close/open the circuit between the positive terminal contact and negative terminal contact of the switch 45. The lamp complete 5 is mounted in the front locating ring 42 of the holder shell assembly 4, having a front cap 51 holding a lamp bulb 52 within the reflector 31, a metal rivet 54 provided at the rear end thereof and connected to the positive terminal contact of the switch 45 by a conductor 55, and a metal spring 53 connected between the positive terminal of the lamp bulb 52 and the metal rivet 54. A conductor 56 connects the negative terminal of the lamp bulb 52 to the negative pole metal contact plate 43 of the holder shell assembly 4. Further, a return spring 50 is mounted around the lamp complete 5 and stopped between the front locating ring 42 of the holder shell assembly 4 and the expanded rear end of the lamp complete 5.

Referring to FIGS. from 1 through 4 again, the lamp complete 5 comprises a beveled stop edge 57 at the periphery of the expanded rear end thereof, and a backwardly extended flange 58. A focal length adjustment device is installed in the metal barrel 1 around the button 451 for adjusting the focal length of the flashlight. The focal length adjustment device comprises a lower actuating member 48, an upper actuating member 49, and a button 40. The lower actuating member 48 comprises a ring 481 mounted around the button 451 of the switch 45, and an actuating rod 482 extended from the ring 481 and stopped at the beveled stop edge 57 at the lamp complete 5. The ring 481 has a plurality of equiangularly spaced hook holes 483. The upper actuating member 49 comprises a ring 491, and a lever 492 extended from the ring 491. The ring 491 of the upper actuating member 49 comprises a plurality of hooks 493 respectively hooked in the hook holes 483 at the ring 481 of the lower actuating member 48, and a retaining notch 494 on the inside. The button 40 is mounted within the ring 491 of the upper actuating member 49 and supported on the button 451 of the switch 45, having a locating rod 401 engaged into the retaining notch 494. Further, O-rings O are respectively mounted around the button 40, the ring 491 of the upper actuating member 49, the connecting area between the metal barrel 1 and the lamp case 2, and the connecting area between the lamp case 2 and the rim 3. The holder shell assembly 4 and the lamp complete 5 are respectively formed of two symmetrical halves coupled together. The lamp complete 5 is allowed to be moved axially within the holder shell assembly 4, but prohibited from rotary motion relative to the holder shell assembly 4. Various measures can be taken to stop the lamp complete 5 from rotary motion relative to the holder shell assembly 4. For example, the holder shell assembly 4 is made having a flat inside wall matched with the beveled stop edge 57 of the lamp complete 5.

Figure 5:
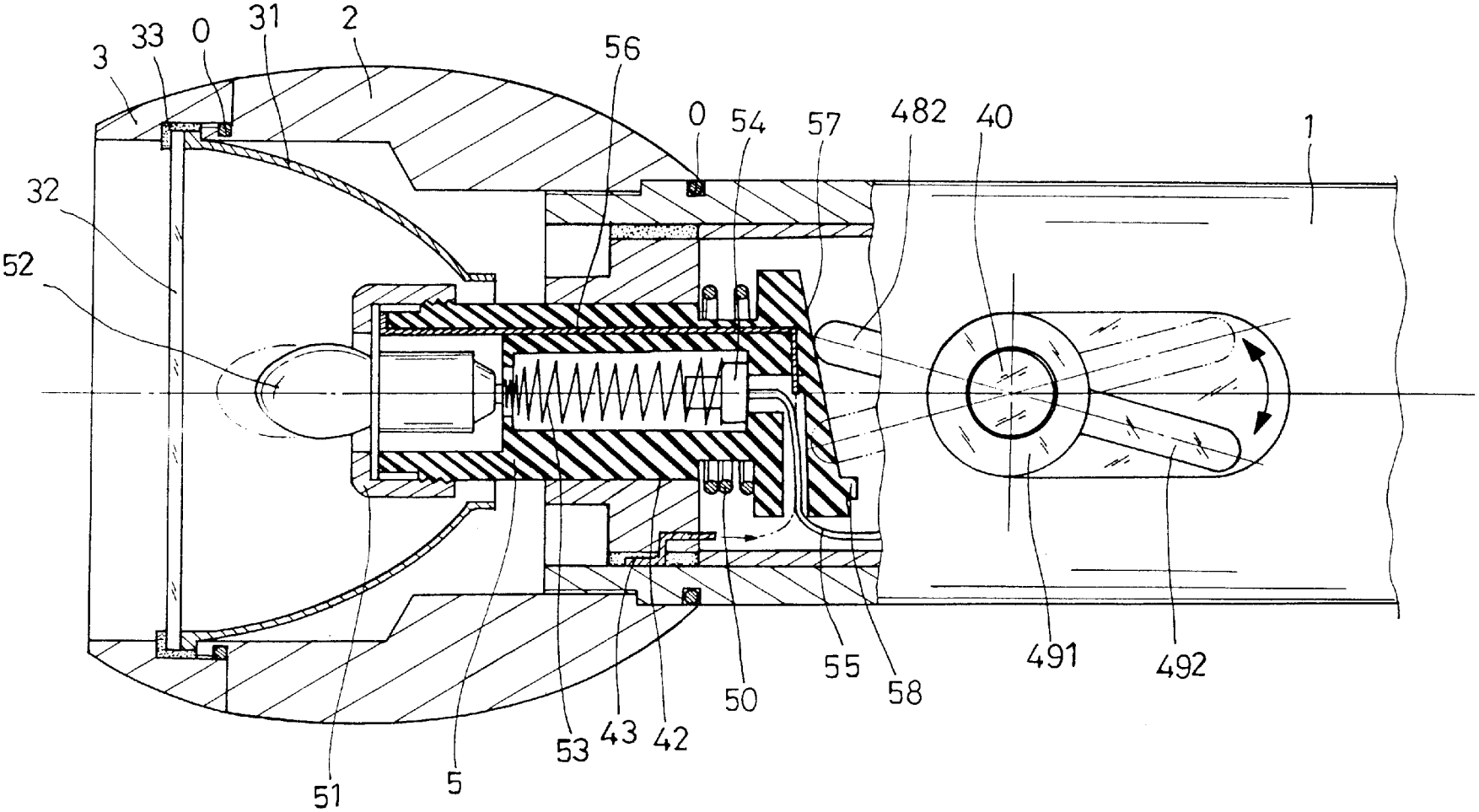
FIG. 5 is a sectional top view in an enlarged scale of the present invention, showing the focal length adjustment device operated, the lamp complete moved backwards.
Figure 6:
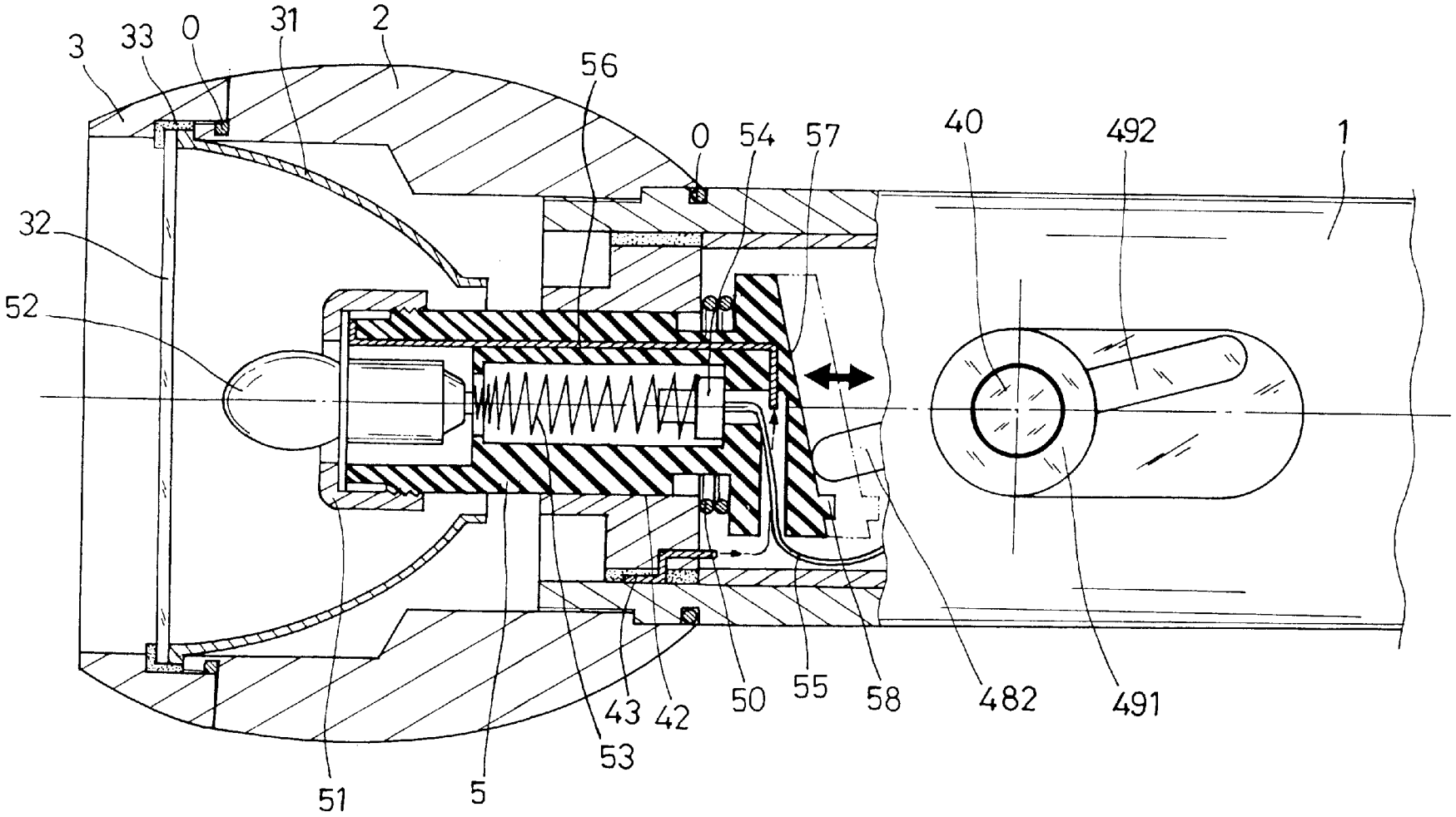
FIG. 6 is similar to FIG. 6 but showing the lamp complete moved forwards.

Referring to FIGS. 5 and 6, turning the lever 492 of the upper actuating member 49 causes the lower actuating member 48 to be rotated leftwards (counter-clockwise) or rightwards (clockwise). Because the actuating rod 482 of the lower actuating member 48 is stopped at the beveled stop edge 57 at the lamp complete 5 and the return spring 50 imparts a backward pressure to the lamp complete 5, rotating the lower actuating member 48 causes the lamp complete 5 to be moved axially forwards or backwards to adjust the pitch between the lamp bulb 52 and the reflector 31, and therefore the focal length of the flash light is relatively adjusted.

While only one embodiment of the present invention has been shown and described, it will be understood that various medications and changes could be made thereunto without departing from the spirit and scope of the invention disclosed.

What the invention claimed is:

1. A flash light of the type comprising:

a metal barrel, said metal barrel comprising an insulative partition board on the middle, a metal rear cap, a battery set mounted in between said partition board and said rear cap, and a button hole at the periphery near a front end thereof;

a lamp case fastened to the front end of said barrel;

a rim covered on said lamp case at a front side, said rim having a sealing rubber mounted on the inside to hold a reflector within said lamp case and a lens in front of said lamp case;

a holder shell assembly mounted in the front end of said barrel, said holder shell assembly comprising a negative pole metal contact plate mounted on the outside at one side and disposed in contact with said barrel, a positive pole metal contact plate provided at a rear end thereof and disposed in contact with the positive terminal of said battery set, and a front locating ring;

a switch mounted on said holder shell assembly, said switch having a positive terminal contact connected to said positive pole metal contact plate at said holder shell assembly, a negative terminal contact, and a button extended out of the button hole at said barrel for operation by hand to close/open the circuit between the positive terminal contact and negative terminal contact of said switch;

a lamp complete mounted in the front locating ring of said holder shell assembly, said lamp complete having a front cap holding a lamp bulb within said reflector, a metal rivet provided at an expanded rear end thereof and connected to the positive terminal contact of said switch, and a metal spring connected between said lamp bulb and said metal rivet, said lamp bulb having a positive terminal connected to the metal spring in said lamp complete and a negative terminal connected to the negative pole metal contact plate at said holder shell assembly; and a return spring mounted around said lamp complete and stopped between the front locating ring of said holder shell assembly and the expanded rear end of said lamp complete;

wherein said lamp complete comprises a beveled stop edge at the expanded rear end thereof, and a stop flange backwardly extended from the expanded rear end; a focal length adjustment device is installed in said metal barrel around the button of said switch for adjusting the focal length of the flash light, said focal length adjustment device comprising a lower actuating member, an upper actuating member, and a button, said lower actuating member comprising a ring mounted around the button of said switch and having a plurality of equiangularly spaced hook holes, and an actuating rod extended from the ring of said lower actuating member and stopped at the beveled stop edge at the expanded rear end of said lamp complete, said upper actuating member comprising a ring coupled to said lower actuating member at a top side, and a lever extended from the ring of said upper actuating member for turning by hand to rotate said lower actuating member, the ring of said upper actuating member comprising a plurality of hooks respectively hooked in the hook holes at the ring of said lower actuating member, and a retaining notch on the inside, the button of said focal length adjustment device being mounted within the ring of said upper actuating member and supported on the button of said switch and having a locating rod engaged into the retaining notch in the ring of said upper actuating member; O-rings are respectively mounted around the button of said focal length adjustment device, the ring of said upper actuating member, the connecting area between said metal barrel and said lamp case, and the connecting area between said lamp case and said rim.

2. The flash light of claim 1 wherein said holder shell assembly and said lamp complete are respectively formed of two symmetrical halves coupled together, and means is provided for enabling said lamp complete to be moved axially within said holder shell assembly and prohibited from rotary motion relative to said holder shell assembly.

* * * * *